US008328421B2

(12) United States Patent
Calvo et al.

(10) Patent No.: US 8,328,421 B2
(45) Date of Patent: Dec. 11, 2012

(54) PUSH-DOWN COMPRESSIBLE POUCH WITH ONE-WAY VALVES ON SIDES

(75) Inventors: Martin Calvo, Chula Vista, CA (US); Linh Pham, Chula Vista, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 697 days.

(21) Appl. No.: 12/361,359

(22) Filed: Jan. 28, 2009

(65) Prior Publication Data

US 2009/0190863 A1 Jul. 30, 2009

Related U.S. Application Data

(60) Provisional application No. 61/024,669, filed on Jan. 30, 2008.

(51) Int. Cl.

| | |
|---|---|
| ***B65D 33/16*** | (2006.01) |
| ***B65D 33/01*** | (2006.01) |
| ***B65D 33/00*** | (2006.01) |
| ***B65D 30/00*** | (2006.01) |
| ***B65D 30/20*** | (2006.01) |

(52) U.S. Cl. ..... 383/64; 383/41; 383/100; 383/105; 383/101; 383/103; 383/107; 383/120

(58) Field of Classification Search ..... 383/64, 383/41, 100, 105, 101, 103, 107, 120
See application file for complete search history.

(56) References Cited

U.S. PATENT DOCUMENTS

| | | | | |
|---|---|---|---|---|
| 3,637,132 | A * | 1/1972 | Gray | 383/100 |
| 4,834,554 | A * | 5/1989 | Stetler et al. | 383/100 |
| 5,351,828 | A * | 10/1994 | Becker et al. | 206/522 |
| 5,540,500 | A * | 7/1996 | Tanaka | 383/43 |
| 5,701,996 | A * | 12/1997 | Goto et al. | 206/287 |
| 6,357,915 | B2 * | 3/2002 | Anderson | 383/100 |
| 6,461,043 | B1 * | 10/2002 | Healy et al. | 383/204 |
| 6,499,600 | B2 | 12/2002 | Koyanagi | |
| 6,729,473 | B2 | 5/2004 | Anderson | |
| 7,708,464 | B2 * | 5/2010 | Tanaka | 383/100 |
| 7,748,904 | B2 * | 7/2010 | Henn et al. | 383/38 |
| 2002/0044702 | A1 * | 4/2002 | Koyanagi | 383/103 |
| 2005/0252816 | A1 * | 11/2005 | Ootsubo | 206/524.8 |
| 2006/0120631 | A1 * | 6/2006 | Tang | 383/100 |

FOREIGN PATENT DOCUMENTS

DE 012289 U1 12/2007

* cited by examiner

*Primary Examiner* — Nathan J Newhouse
*Assistant Examiner* — Derek Battisti

(57) ABSTRACT

Airtight compressible storage containers (e.g., pouches) having one-way valves in the form of respective collapsible channels that run along and adjacent to respective pouch side seals. Each collapsible channel comprises unsealed sections of web material that span the space between a respective side seal and a respective interior seal. Each collapsible channel communicates with a respective air inlet located in the interior volume of the pouch and a respective air outlet located on a periphery of the pouch. When the contents of the pouch are compressed by a user pushing down on pouch, air from the storage chamber containing the compressible contents can be forced into the air inlet, through the open channel and out the air outlet until the desired amount of air has been removed from the pouch.

15 Claims, 6 Drawing Sheets

PUSH-DOWN COMPRESSIBLE POUCH WITH ONE-WAY VALVES ON SIDES

RELATED PATENT APPLICATION

This application claims the benefit, under Title 35, United States Code, §119(e), of U.S. Provisional Application Ser. No. 61/024,669 filed on Jan. 30, 2008.

BACKGROUND OF THE INVENTION

This invention generally relates to reclosable flexible storage containers (e.g., pouches) whose interior volume is hermetically sealed (i.e., airtight) when the container is closed. In particular, the invention relates to, but is not limited to, airtight reclosable storage containers that can be collapsed by removal of air from the interior.

Collapsible reclosable storage containers typically include a flexible, airtight pouch, an opening through which an article is inserted inside the pouch, a zipper for closing the opening and hermetically sealing the pouch, and a one-way valve through which excess air is removed from the pouch. A user places an article into the pouch through the opening, seals the opening, and then removes air from the pouch via the one-way valve. During air removal, a compressible article contained therein may be significantly compressed so that it is easier to transport and requires substantially less storage space.

For one category of compressible reclosable storage pouches, air is removed from the interior volume via one or more one-way valves, each one-way valve being a channel that allows air to escape when the contents of the pouch are compressed, but prevents the return of ambient air into the pouch when the pressure is released. Typically the contents are compressed and air inside the pouch is forced out when the user presses down on the pouch and its contents. However, if a one-way valve channel is disposed adjacent and parallel to a bottom seal, it is possible that a user could accidentally place his hands over the channel. In that situation, when the user presses down on the pouch, the pressure on the channel would make it more difficult to expel air through the now-blocked channel.

There is a need for an improved construction of compressible storage containers that would avoid the user accidentally applying pressure on the one-way valve channel (or channels) when attempting to compress the pouch contents, so that the escape of air via the channel will not be obstructed while the pouch is being pressed.

BRIEF DESCRIPTION OF THE INVENTION

The present invention is directed to airtight compressible storage containers (e.g., pouches) having one-way valves in the form of respective collapsible channels that run along and adjacent to respective pouch side seals. Each collapsible channel comprises unsealed sections of web material that span the space between a respective side seal and a respective interior seal. Each collapsible channel communicates with a respective air inlet located in the interior volume of the pouch and a respective air outlet located on a periphery of the pouch. When the contents of the pouch are compressed by a user pushing down on the pouch, air from the storage chamber containing the compressible contents is forced through the air inlet and into the channel, thereby forcing the collapsed channel open. When the channel has been fully opened, continued pushing down on the pouch causes the air that was forced into the channel to escape via the air outlet. This procedure can be continued until the desired amount of air has been removed from the pouch. When the pressure exerted on the pouch by the user is removed, the channel collapses, thereby blocking the re-entry of ambient air into the pouch. Because the collapsible channels are located at the sides of the pouch, the risk that the user will accidentally obstruct the flow of air through the channel is reduced.

One aspect of the invention is a reclosable pouch comprising: a receptacle having a storage chamber and a mouth in communication with the storage chamber, and an airtight closure for closing the mouth, wherein the receptacle comprises first and second walls made of thermoplastic web material, an air outlet adjacent an edge of the first wall, a first side seal that includes respective first marginal portions of the first and second walls, a second side seal that includes respective second marginal portions of the first and second walls, a seal that includes respective portions of the first and second walls and is parallel to and spaced apart from the first side seal, respective unsealed portions of the first and second walls bridging a first portion of the first side seal and a first portion of the seal to form a collapsible channel, wherein the collapsible channel is in flow communication with the air outlet when the collapsible channel is not collapsed.

Another aspect of the invention is a reclosable pouch comprising: a receptacle having a storage chamber and a mouth in communication with the storage chamber, and an airtight closure for closing the mouth, wherein the receptacle comprises first and second walls made of thermoplastic web material, a first side seal that includes respective first marginal portions of the first and second walls, the first side seal having a gap therein that forms an air outlet, a second side seal that includes respective second marginal portions of the first and second walls, a first seal that includes respective first portions of the first and second walls and is parallel to and spaced apart from the first side seal, respective unsealed portions of the first and second walls bridging a first portion of the first side seal and a first portion of the first seal to form a collapsible channel, and a second seal that includes respective second portions of the first and second walls and extends from the first side seal to a location that is spaced from a first end of the first seal by a second gap that forms an air inlet, the air inlet being in flow communication with the air outlet when the collapsible channel is not collapsed.

A further aspect of the invention is a reclosable pouch comprising: a receptacle having a storage chamber and a mouth that is in flow communication with the interior volume, and an airtight closure for closing the mouth, wherein the receptacle comprises first and second walls and a bottom gusset made of thermoplastic web material, a first side seal that includes respective first marginal portions of the first and second walls and the bottom gusset, a second side seal that includes respective second marginal portions of the first and second walls and the bottom gusset, a first bottom seal that includes respective third marginal portions of the first wall and the bottom gusset, a second bottom seal that includes a third marginal portion of the second wall and a fourth marginal portion of the bottom gusset, an interior seal that includes respective first portions of the first and second walls and the bottom gusset and is parallel to and spaced apart from the first side seal, and an air outlet formed by a gap in the first bottom seal, respective unsealed portions of the first and second walls bridging a first portion of the first side seal and a first portion of the interior seal to form a first section of a collapsible channel that is in flow communication with the storage chamber of the receptacle, and respective unsealed portions of the first wall and the bottom gusset bridging a second portion of the first side seal and a second portion of the interior seal to form a second section of the collapsible channel, wherein the first section of the collapsible channel is in flow communication with the air outlet via the second section of the collapsible channel when the first and second sections of the collapsible channel are not collapsed.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
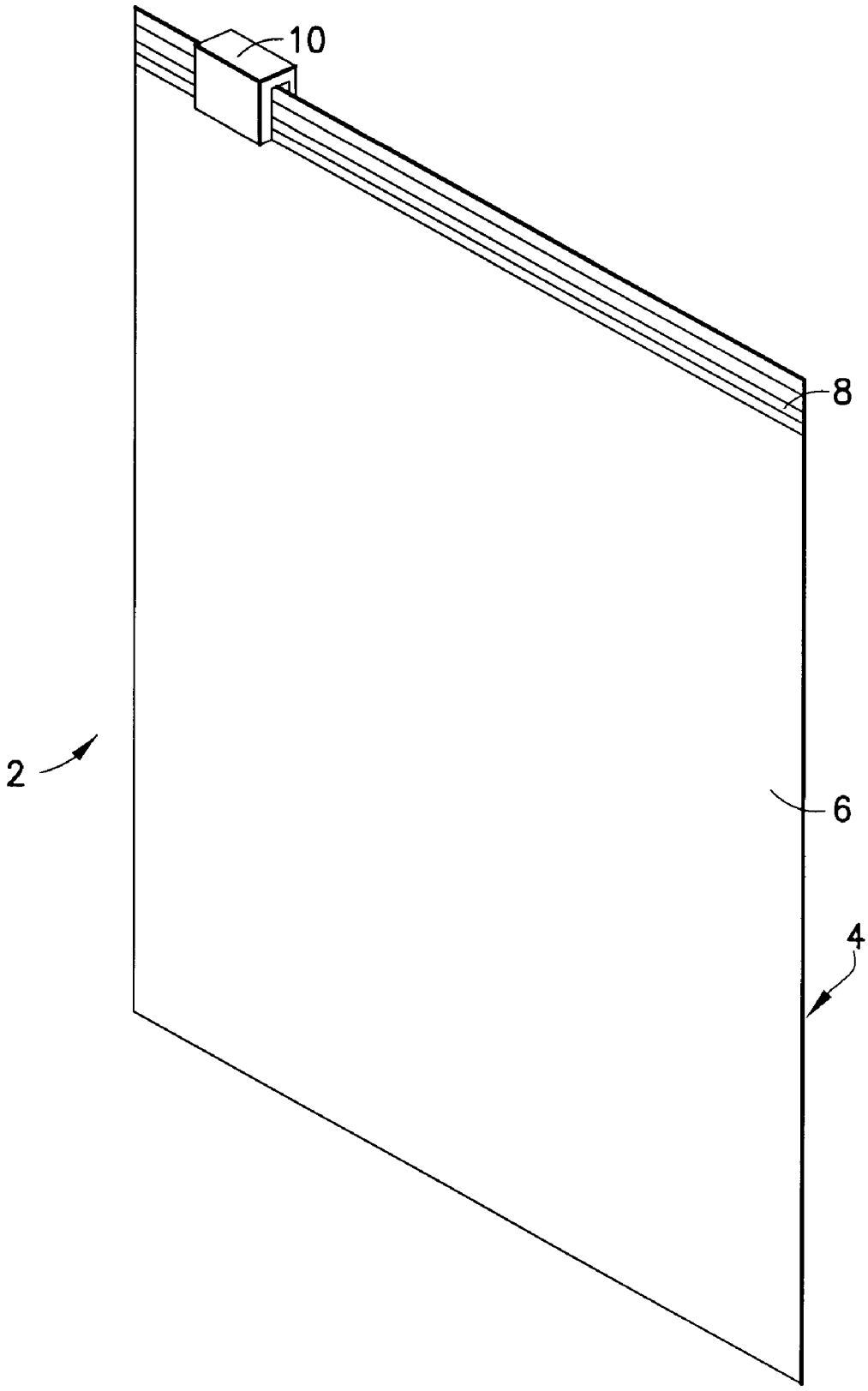
FIG. 1 is a drawing showing an isometric view of one conventional type of collapsible reclosable storage pouch.

FIG. 1 shows a collapsible reclosable storage pouch 2 in accordance with one embodiment of the invention. The storage pouch 2 comprises a receptacle 4 consisting of a front wall or panel 6, a rear wall or panel (not shown) and a bottom gusset (not shown). The upper marginal portions of the front and rear walls form a mouth in which a plastic zipper 8 is installed. Although not shown in FIG. 1, the receptacle 4 incorporates side channels that act as one-way valves to allow escape of air from the interior volume when the contents (not shown) of the receptacle are compressed, but prevent the entry of air into the receptacle when the external pressure is released.

During use, one or more discrete compressible articles (not shown) may be placed inside the receptacle 4 while the zipper 8 is open, i.e., while the closure profiles of the interlockable zipper strips are disengaged from each other. After the article to be stored has been placed inside the receptacle, the mouth of the receptacle 4 can be sealed by pressing the zipper strips together to cause their respective closure profiles to interlock. Although the zipper closure profiles may have many different designs, the design must be one that ensures formation of an airtight seal at the receptacle mouth.

Still referring to FIG. 1, the zipper strips can be pressed together using a device 10 commonly referred to as a "slider" or "clip", which straddles the zipper. The typical slider has a generally U-shaped profile, with respective legs disposed on opposing sides of the zipper. The gap between the slider legs is small enough that the zipper can pass through the slider gap only if the zipper is in a closed state. Thus when the slider is moved along an open zipper, this has the effect of pressing the incoming sections of the zipper strips together. A suitable slider is disclosed in U.S. patent application Ser. No. 10/940,213. The zipper is opened by pulling apart the zipper upper flanges, as explained in more detail below. The slider can be molded from any suitable plastic.

The front and rear wall panels of the receptacle 4 are respectively sealed to the zipper by lengthwise conduction heat sealing in conventional manner. Alternatively, the zipper can be attached to the wall panels by adhesive or bonding strips or the zipper can be extruded integrally with the web material. The walls of the receptacle may be formed of various types of gas-impermeable thermoplastic web material. The preferred gas-impermeable thermoplastics are nylon, polyester, polyvinyl dichloride and ethylene vinyl alcohol. The web material may be either transparent or opaque.

To maintain a vacuum inside the storage pouch, the zipper in a closed state must provide a hermetic seal at the mouth (i.e., fourth side) of the pouch. The present invention is not directed to any particular zipper construction. For the sake of illustration, however, a suitable zipper for use with the present invention will now be described with reference to FIG. 2.

Figure 2:
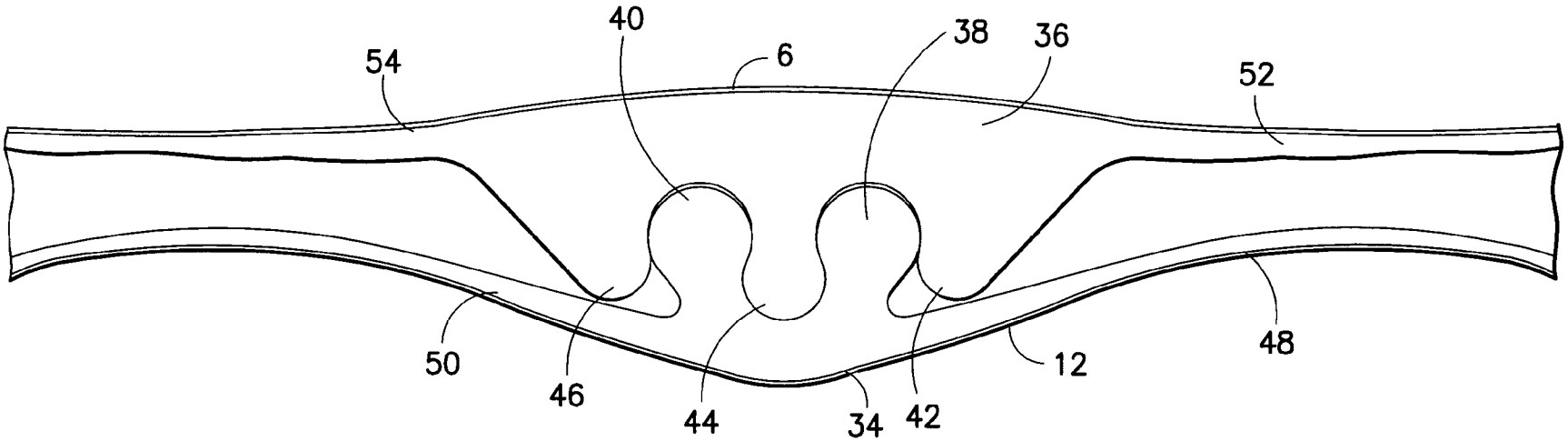
FIG.2 PRIOR ART
FIG. 2 is a drawing showing a cross-sectional view of a known zipper suitable for use with a pouch of the type depicted in FIG. 1.

FIG. 2 shows a conventional zipper 8 that comprises a pair of mutually interlockable extruded zipper strips 34 and 36. The zipper strip 34 comprises a pair of projections 38 and 40 having ball-shaped closure profiles, an upper flange 48, and a lower flange 50. The zipper strip 36 comprises three projections 42, 44 and 46 (projection 44 has a ball-shaped closure profile), an upper flange 52, and a lower flange 54. For each zipper strip, the portions exclusive of the projections will be referred to herein as a "base". The front wall 6 and rear wall 12 of the receptacle may be joined to the respective bases of the zipper strips by conduction heat sealing across their entire height or across only portions thereof. For example, the pouch walls could be joined to the zipper lower flanges and to the upper flanges by means of conduction heat sealing.

Still referring to FIG. 2, the projections 38 and 40 interlock with projections 42, 44 and 46 by fitting inside the respective spaces therebetween. The upper flanges 48 and 52 can be gripped by the user and pulled apart to open the closed zipper. The opened zipper can be reclosed by pressing the zipper strips together (e.g., using a slider) along the entire length of the zipper with sufficient force to cause the projections 38 and 40 to enter the respective spaces between the projections 42, 44 and 46. Typically, such a slider takes the form of a U-shaped clip that fits over the zipper with clearance for the upper flanges, while the legs of the clip cam the zipper profiles of the incoming zipper section into engagement when the slider is moved along the zipper in either direction. Typically, the ends of the zipper strips 34 and 36 are joined together at the sides of the pouch. The ends of the zipper strips may be fused together at the same time that the container side seals are formed. The side seals are typically formed by applying heat and pressure in amounts sufficient to fuse and flatten the closure profiles at the ends of the zipper, which process is often called "thermal crushing".

In accordance with the embodiments disclosed hereinafter, an airtight compressible storage pouch is provided with one-way valves in the form of respective collapsible channels that run along and adjacent to respective pouch side seals. Each collapsible channel communicates with a respective air inlet located in the interior volume of the pouch and a respective air outlet located on a periphery of the pouch. When the contents of the pouch are compressed by a user pushing down on the pouch, air from the storage chamber containing the compressible contents is forced through the air inlet and into the channel, thereby forcing the collapsed channel open. When the channel has been fully opened, continued pushing down on the pouch causes the air that was forced into the channel to escape via the air outlet. This procedure can be continued until the desired amount of air has been removed from the pouch. When the pressure exerted on the pouch by the user is removed, the channel collapses, thereby blocking the re-entry of ambient air into the pouch. Because the collapsible channels are located at the sides of the pouch, the risk that the user will accidentally obstruct the flow of air through the channel is reduced.

Figure 3:
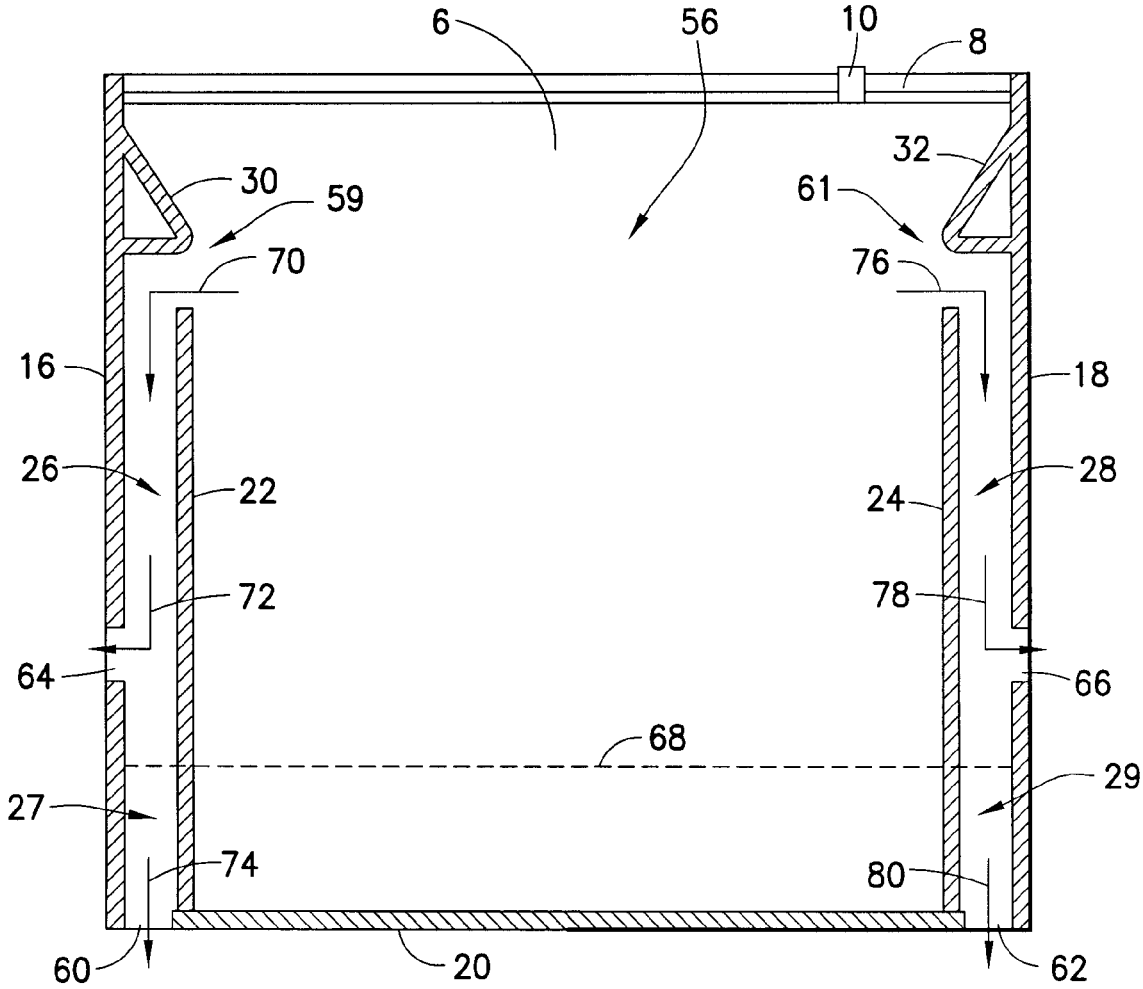
FIG. 3 is a drawing showing a plan view of an airtight compressible reclosable storage pouch having a bottom gusset in accordance with one embodiment of the invention. The hatching indicates heat seals and the dashed line indicates a bottom gusset.

A collapsible reclosable storage pouch having one-way valves on respective sides thereof in accordance with one embodiment is shown in FIG. 3, in which heat-sealed regions are indicated by hatching. For ease of description, the empty pouch is shown in a planar state. The reclosable pouch comprises a receptacle having a storage chamber 56 and a mouth in communication with the storage chamber, and an airtight zipper 8 for closing said mouth. Other types of airtight closures can be used instead of a zipper, e.g., opposing strip-shaped layers of low-tack adhesive or cohesive material. The receptacle comprises a front wall 6 and a rear wall (not shown in FIG. 3), both walls being rectangular panels made of thermoplastic web material. A first side seal 16 includes respective first marginal portions of the front and rear walls, while a second side seal 18 includes respective second marginal portions of the front and rear walls. The first side seal 16 has a gap 64 therein that forms an air outlet, while the second side seal 16 has a gap 66 therein that forms another air outlet.

Still referring to FIG. 3, the receptacle further comprises a bottom gusset 68 that is formed by folding rectangular section of thermoplastic web material and placing the folded web material between the lower portions of the front and rear walls before the side seals are formed by heat sealing, thereby capturing a first folded marginal portion of the gusset bottom in the first side seal 16 and capturing a second folded marginal portion of the gusset bottom in second side seal 18. The dashed line in FIG. 3 indicates the apex of the folded gusset bottom. The portions of side seals 16 and 18 disposed at elevations above the dashed line in FIG. 3 consist of respective marginal portions of the front and rear walls that have been joined together by heat sealing, while the portions of side seals 16 and 18 disposed at elevations below the dashed line in FIG. 3 consist of respective folded marginal portions of the gusset bottom sandwiched between respective marginal portions of the front and rear walls, each folded marginal portion of the gusset bottom being joined by heat sealing to itself and to the respective marginal portions of the front and rear walls on opposite sides thereof.

Figure 4:
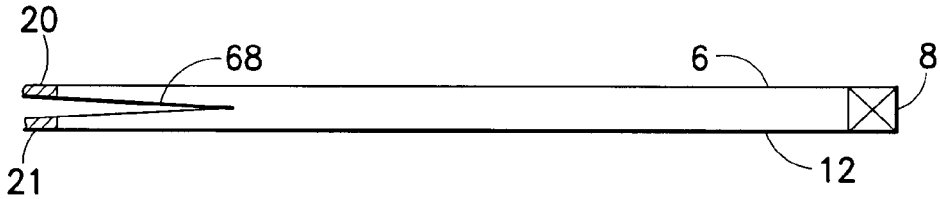
FIG. 4 is a drawing showing a folded web inserted between the bottom sections of a pair of mutually confronting webs during the manufacture of a reclosable storage pouch having a bottom gusset in accordance with one embodiment of the invention.

The relationship of the folded gusset bottom 68 to the front wall 6 and rear wall 12 is shown in FIG. 4. One marginal portion of the gusset bottom is joined to a marginal portion of front wall 6 by a first bottom seal 20 (see also FIG. 3), while another marginal portion of the gusset bottom is joined to a marginal portion of rear wall 12 by a second bottom seal 21, both bottom seals being formed by conventional heat sealing (i.e., by the application of pressure and heat sufficient to meld the aforementioned marginal portions).

For the embodiment depicted in FIG. 3, the first bottom seal 20 does not extend the full width of the receptacle. Instead a first end of the first bottom seal 20 is separated from an end of the first side seal 16 by a gap 60 that forms a third air outlet, while a second end of the first bottom seal 20 is separated from an end of the second side seal 18 by a gap 62 that forms a fourth air outlet. The bottom seal 21 may optionally have similar gaps.

During manufacture of the embodiment depicted in FIG. 3, a first interior seal 22 is formed that extends parallel to and spaced apart from the first side seal 16, and a second interior seal 24 is formed that extends parallel to and spaced apart from the second side seal 18. One end of the interior seal 22 is contiguous with the bottom seal 20 (as well as bottom seal 21 seen in FIG. 4). Likewise one end of the interior seal 24 is contiguous with the bottom seal 20 (as well as bottom seal 21). The interior seals 22 and 24 are both formed by conductive heat sealing in a well-known manner using a heated sealing bar. The storage chamber 56, in which the compressible contents are placed before air removal, is bounded by the first and second interior seals 22 and 24.

The first interior seal 22 includes a first section wherein respective portions of the front and rear walls are heat sealed together. The first interior seal 22 also includes a second section wherein respective portions of the front and rear walls and the bottom gusset are heat sealed together. The boundary between the first and second sections of the first interior seal 22 is located where the horizontal dashed line in FIG. 3 intersects the first interior seal 22. As a result of the formation of the first interior seal 22, respective unsealed portions of the front and rear walls span the space between a first portion of the first side seal 16 and a first portion of the first interior seal 22 to form a first collapsible channel 26, the lower limit of which is generally indicated by the horizontal dashed line in FIG. 3. Furthermore, respective unsealed portions of the front wall 6 and bottom gusset 68 span the space between a second portion of the first side seal 16 and a second portion of the first interior seal 22 to form a second collapsible channel 27, the upper limit of which is generally indicated by the horizontal dashed line in FIG. 3. The first and second collapsible channels 26 and 27 are in fluid communication when those channels are not collapsed.

Similarly, the second interior seal 24 includes a first section wherein respective portions of the front and rear walls are heat sealed together, and a second section wherein respective portions of the front and rear walls and the bottom gusset are heat sealed together. The boundary between the first and second sections of the second interior seal 24 is located where the horizontal dashed line in FIG. 3 intersects the second interior seal 24. As a result of the formation of the second interior seal 24, respective unsealed portions of the front and rear walls span the space between a first portion of the second side seal 18 and a first portion of the second interior seal 24 to form a third collapsible channel 28, the lower limit of which is generally indicated by the horizontal dashed line in FIG. 3. Furthermore, respective unsealed portions of the front wall 6 and bottom gusset 68 span the space between a second portion of the second side seal 18 and a second portion of the first interior seal 22 to form a fourth collapsible channel 29, the upper limit of which is generally indicated by the horizontal dashed line in FIG. 3. When not collapsed, the third and fourth collapsible channels 28 and 29 are in fluid communication with each other.

Although not shown in FIG. 3 because they are located directly behind the collapsible channels 27 and 29, additional collapsible channels are formed by the bottom gusset and rear wall. More specifically, respective unsealed portions of the rear wall and the bottom gusset 68 span the space between the aforementioned second portion of the first side seal 16 and the aforementioned second portion of the first interior seal 22 to form a fifth collapsible channel directly behind the collapsible channel 27, which fifth collapsible channel is also in fluid communication with the collapsible channel 26 when those channels are not collapsed. Similarly, respective unsealed portions of the rear wall and the bottom gusset 68 span the space between the aforementioned second portion of the second side seal 18 and the aforementioned second portion of the second interior seal 24 to form a sixth collapsible channel directly behind the collapsible channel 29, which sixth collapsible channel is also in fluid communication with the collapsible channel 28 when those channels are not collapsed.

In the disclosed embodiment, each collapsible channel has a constant width and extends parallel to the side seals 16, 18 and perpendicular to the zipper 8 and the bottom seals 20, 21.

As seen in FIG. 3, the receptacle further includes a first angled seal 30 that includes respective portions of the front and rear walls that have been joined by heat sealing. The first angled seal 30 includes a leg that extends from the first side seal 16 to a location that is spaced from a distal end of the first interior seal 22 by a gap that forms a first air inlet 59. The first air inlet 59 will be in flow communication with the first air outlet 64 when the first collapsible channel 26 is not collapsed, and will be in flow communication with the third air outlet 60 when the first and second collapsible channels 26 and 27 are not collapsed. On the other side, the receptacle further includes a second angled seal 32 that includes respective portions of the front and rear walls that have been joined by heat sealing. The second angled seal 32 includes a leg that extends from the second side seal 18 to a location that is spaced from a distal end of the second interior seal 24 by a gap that forms a second air inlet 61. The second air inlet 61 will be in flow communication with the third air outlet 66 when the third collapsible channel 28 is not collapsed, and will be in flow communication with the fourth air outlet 62 when the third and fourth collapsible channels 28 and 29 are not collapsed.

During use of the pouch depicted in FIG. 3, the zipper 8 is opened and then the storage chamber 56 is loaded with compressible contents. The zipper 8 is then closed, thereby hermetically sealing the mouth of the receptacle. If the user then places the loaded pouch on a support surface and pushes down on the loaded pouch, thereby compressing the compressible contents, air will be forced out of the pouch via the flow paths indicated by arrows 70, 72, 74 on one side and via the flow paths indicated by arrows 76, 78, 80 on the other side. More specifically, arrow 70 indicates the flow of air through the first air inlet 59 and into the first collapsible channel 26; arrow 72 indicates the flow of air through the first collapsible channel 26 and then out the first air outlet 64; arrow 74 indicates the flow of air through the second collapsible channel 27 and then out the third air outlet 60; arrow 76 indicates the flow of air through the second air inlet 61 and into the third collapsible channel 28; arrow 78 indicates the flow of air through the third collapsible channel 28 and then out the second air outlet 66; and arrow 80 indicates the flow of air through the fourth collapsible channel 29 and then out the fourth air outlet 62 (the flows through the fifth and sixth collapsible channels are not shown in FIG. 3).

When the user pushes down on the loaded pouch, the air pressure causes the collapsible channels to open. When the external pressure is released, the collapsible channels collapse (i.e., close), thereby preventing the entry of ambient air into the receptacle.

Figure 5:
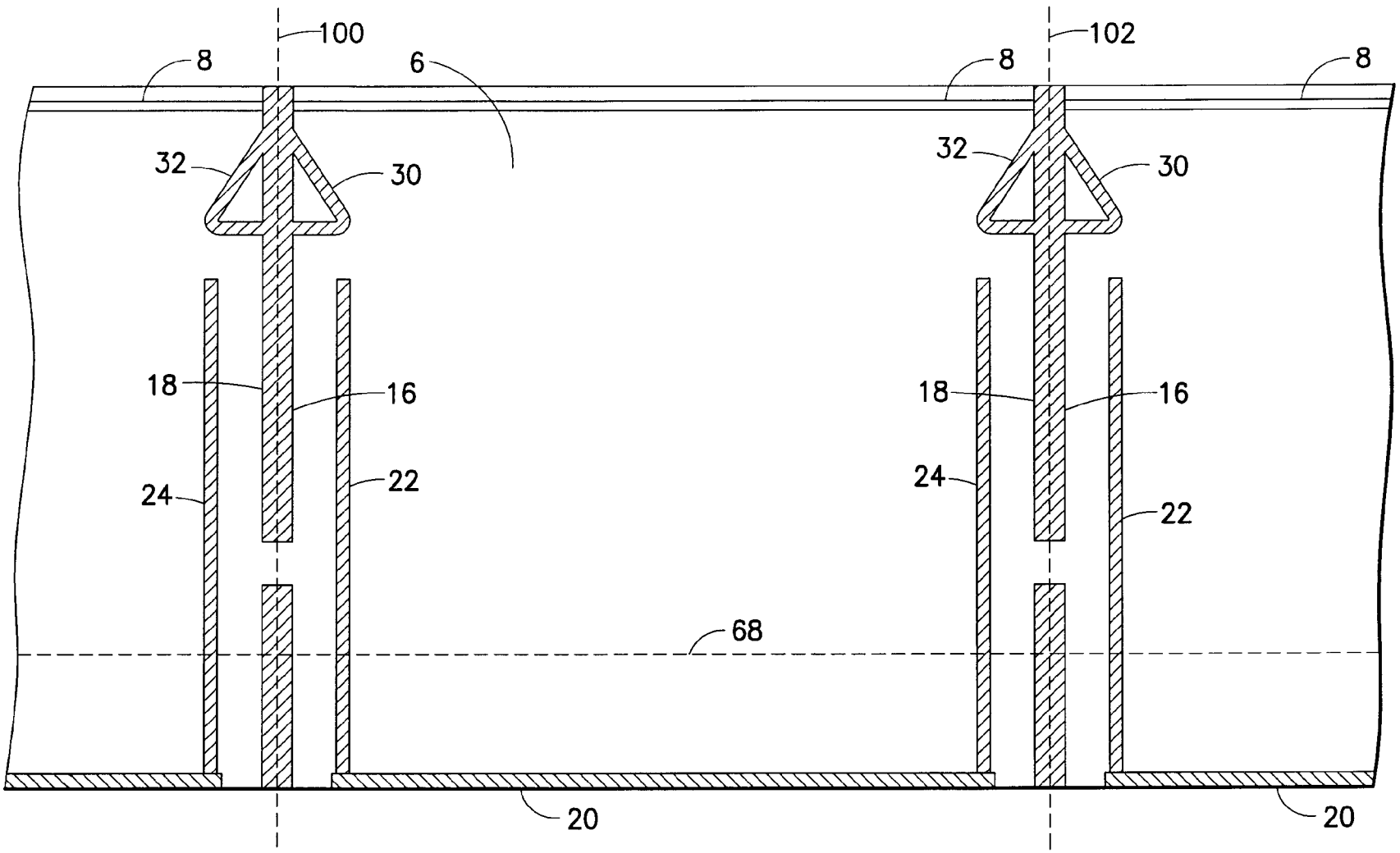
FIG. 5 is a drawing showing a plan view of a stage in the automated manufacture of pouches of the type shown in FIGS. 3 and 4. The horizontal dashed line indicates a bottom gusset formed in each pouch; the vertical dashed lines indicate cut lines, and the hatching indicates heat-sealed regions.

FIG. 5 is a drawing showing a plan view of a stage in the automated manufacture of pouches of the type shown in FIGS. 3 and 4. Pouches are produced by paying out first and second webs of thermoplastic material, having the same width, which are placed in overlying relationship. A zipper tape is also paid out, arranged between marginal portions on one side of the first and second webs, and then joined to both webs by conductive heat sealing. Also a third intervening web of thermoplastic material, narrower in width, is paid out, and folded. The intervening folded web (which is the precursor for bottom gussets 68) is arranged between marginal portions on the other side of the first and second webs and then heat sealed thereto. The three webs are heat sealed to form channels using a heated sealing bar that has formed thereon the pattern depicted by hatching in FIG. 5. After heat sealing, a separate pouch is made by severing along the cut lines 100 and 102, indicated in FIG. 5 by vertical dashed lines.

Figure 6:
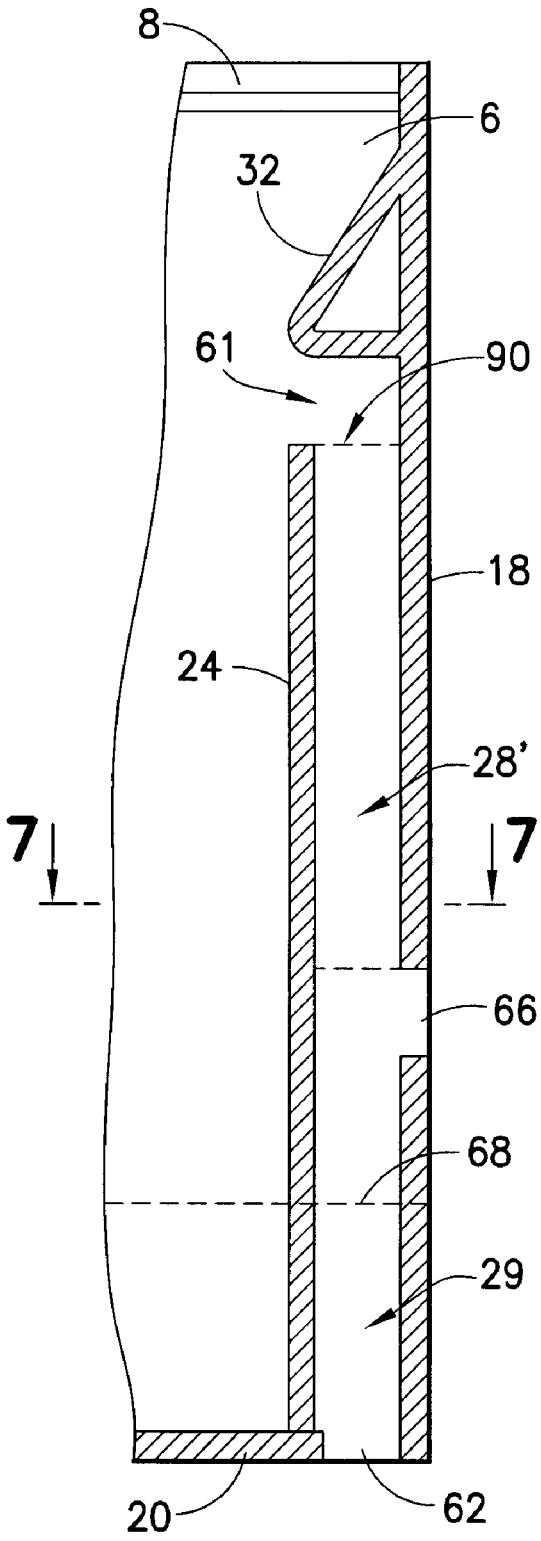
FIG. 6 is a drawing showing a plan view of an airtight compressible reclosable storage pouch having a bottom gusset and having a collapsible channel on each side, each channel being a double-layered one-way valve in accordance with another embodiment of the invention. The dashed lines indicate the extent of the double-layered one-way valve, while the hatching indicates heat seals.

In accordance with a further embodiment, two intervening layers of valve film material, each having a smoothness greater than the smoothness of the thermoplastic web material of the pouch walls and bottom gusset, are incorporated in one or more collapsible channels. In forming the valve film layers, various materials may be employed. Such materials include, but are not limited to, low-density polyethylene (LDPE) or linear low-density polyethylene (LLDPE). FIG. 6 shows a portion of an airtight compressible reclosable storage pouch having a bottom gusset 68 and further having a double-layered one-way valve 90 installed as part of a collapsible channel 28' disposed on one side of the pouch. [A similar double-layered one-way valve is installed as part of a collapsible channel disposed on the other side of the pouch (not shown).] The two horizontal dashed lines in FIG. 6 that extend between seals 18 and 24 indicate the extent of the double-layered one-way valve 90, while the hatching indicates the pattern of heat seals as previously described.

Figure 7:
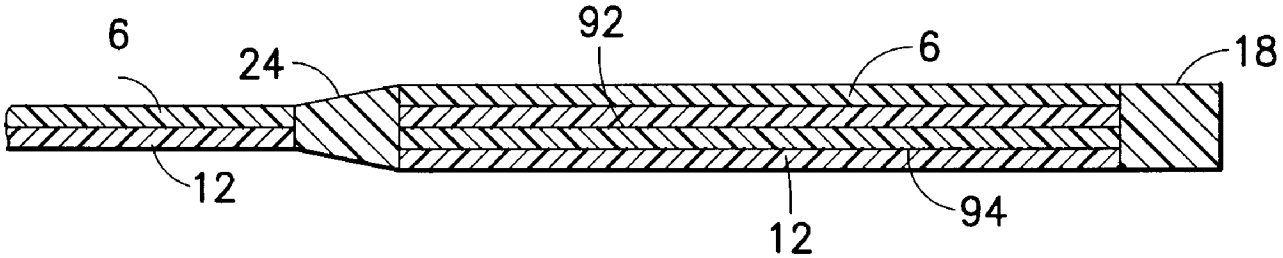
FIG. 7 is a drawing showing a cross-sectional view of the double-layered one-way valve depicted in FIG. 6, in a collapsed state, the section being taken along the line 7-7 indicated in FIG. 6.

FIG. 7 is a cross-sectional view of the double-layered one-way valve depicted in FIG. 6, in a collapsed state, the section being taken along the line 7-7 indicated in FIG. 6. The double-layered one-way valve comprises a portion of a front wall 6, a first layer 92 of valve film, a second layer of valve film 94 and a portion of a rear wall 12. The layers of valve film 92 and 94 may be rectangular pieces of valve film disposed between the front and rear walls 6 and 12. Marginal portions of the front and rear walls and the first and second layers of valve film are joined at the side heat seal 18; while portions of the front and rear walls and other marginal portions of the first and second layers of valve film are joined at the interior heat seal 24. The ends of the valve film layers 92, 94 located closest to the air inlet 61 should be respectively sealed to the front and rear walls 6, 12 to avoid air entry between the pouch walls and the valve film.

Figure 8:
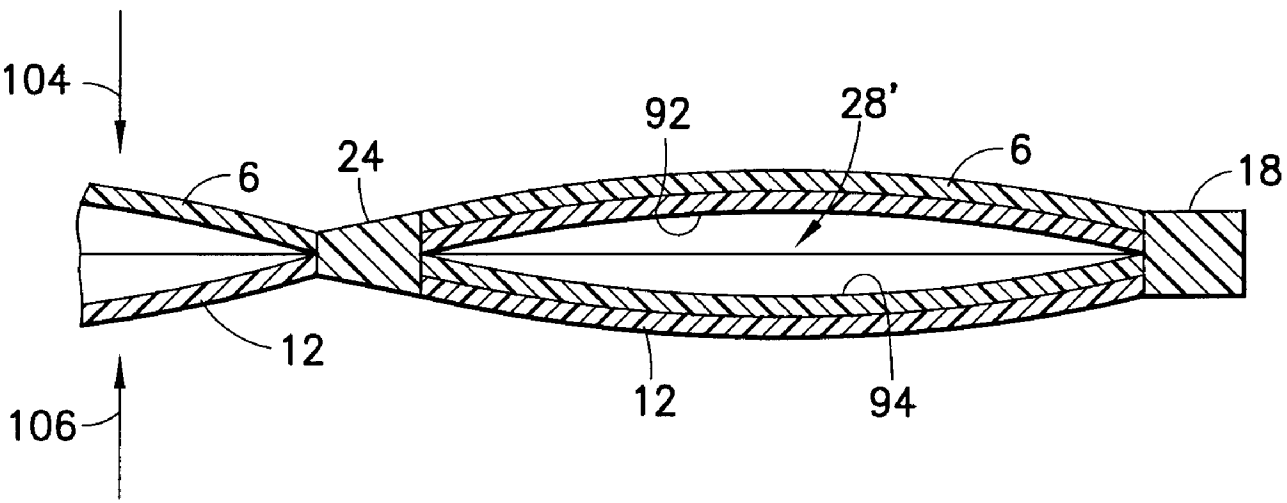
FIG. 8 is a drawing showing a cross-sectional view, similar to FIG. 7, but showing the opened (i.e., not collapsed) state of the double-layered one-way valve when the pouch is partially filled with air.

FIG. 8 is a drawing showing a cross-sectional view, similar to FIG. 7, but showing the opened (i.e., not collapsed) state of the double-layered one-way valve while air is being removed from the pouch by application of external pressure on the loaded storage chamber, as indicated by arrows 104, 106. As a result, the air being removed from the pouch travels between the two valve film layers 92, 94. Since the valve film layers are smooth, regardless of any texture imparted to the pouch walls, a reliable seal of the valve is obtained. When no external pressure is physically exerted on the pouch walls 6, 12, ambient atmospheric pressure is sufficient to press the valve film layers 92, 94 toward one another, effectively closing the channel (as seen in FIG. 7), thereby impeding unwanted air from entering the channel 28' and the storage chamber.

A person of ordinary skill in the art will appreciate that instead of two valve film layers (as seen in FIGS. 7 and 8), one valve film layer could be used (not shown in the drawings).

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, welded, bonded, sealed, adhered, etc., whether by application of heat and/or pressure, application of ultrasonic energy, application of a layer of adhesive material or bonding agent, interposition of an adhesive or bonding strip, co-extrusion (e.g., of zipper and bag), etc. Also, as used in the claims, the phrase "gap in a bottom seal" should be construed to include, but is not limited to, a gap between an end of a bottom seal and an end of a side seal".

The invention claimed is:

1. A reclosable pouch comprising:

a front wall having top and bottom edges and left and right side edges, a rear wall having top and bottom edges and left and right side edges, a folded bottom gusset disposed between lowermost portions of said front and rear walls and having first and second bottom edges and left and right side edges, and an airtight closure disposed between and joined to uppermost portions of said front and rear walls, wherein said front and rear walls are joined to each other and to said folded bottom gusset by an array of seals comprising:

a right side seal comprising an upper portion where said right side edges of said front and rear walls are joined together and a lower portion where said right side edges of the front and rear walls are joined to said right side edge of said folded bottom gusset;

a left side seal comprising an upper portion where said left side edges of said front and rear walls are joined together and a lower portion where said left side edges of the front and rear walls are joined to said left side edge of said folded bottom gusset;

a left interior seal that is parallel to and spaced apart from said left side seal, said left interior seal comprising an upper portion where said front and rear walls are joined together and a lower portion where said front and rear walls are joined to said folded bottom gusset; and a first bottom seal where said bottom edge of said front wall is joined to one of said first and second bottom edges of said folded bottom gusset; and a second bottom seal where said bottom edge of said rear wall is joined to the other of said first and second bottom edges of said folded bottom gusset, and wherein portions of said front and rear walls that span a space between said left side seal and said left interior seal form a left collapsible channel that ends at said bottom edges of said front and rear walls, and portions of said folded bottom gusset that span said space between said left side seal and said left interior seal form a portion of said left collapsible channel, a storage chamber internal to said pouch and the ambient atmosphere external to said pouch being in fluid communication via said left collapsible channel when said left collapsible channel is open along its entire length.

2. The reclosable pouch as recited in claim 1, wherein said array of seals further comprises:

a right interior seal that is parallel to and spaced apart from said right side seal, said right interior seal comprising an upper portion where said front and rear walls are joined together and a lower portion where said front and rear walls are joined to said folded bottom gusset, wherein portions of said front and rear walls that span a space between said right side seal and said right interior seal form a right collapsible channel that ends at said bottom edges of said front and rear walls, and portions of said folded bottom gusset that span said space between said right side seal and said right interior seal form a portion of said right collapsible channel.

3. The reclosable pouch as recited in claim 1, wherein said upper portion of said left side seal comprises first and second side seal segments separated by a left side air outlet, said storage chamber and the ambient atmosphere being in fluid communication via a portion of said left collapsible channel and said left side air outlet when said portion of said left collapsible channel is open and being not in fluid communication via said portion of said left collapsible channel and said left side air outlet when said portion of said left first collapsible channel is closed.

4. The reclosable pouch as recited in claim 1, wherein said airtight closure comprises a zipper having interengageable profile elements.

5. The reclosable pouch as recited in claim 1, wherein a length of said left interior seal is greater than half a length of said left side seal.

6. The reclosable pouch as recited in claim 1, wherein said array of seals further comprises a V-shaped interior seal having respective ends that meet said left side seal at respective locations and having a vertex disposed above and separated from an upper end of said left interior seal.

7. A reclosable pouch comprising: a front wall, a rear wall, a folded bottom gusset disposed between lowermost portions of said front and rear walls, left and right side seals, left and right interior seals, and an airtight closure disposed between and joined to uppermost portions of said front and rear walls, wherein respective portions of said front and rear walls form left and right collapsible channels, an interior of said pouch being in fluid communication with an exterior of said pouch when either of said left and right collapsible channels is open, said left collapsible channel being bounded by said left side seal and said left interior seal, and said right collapsible channel being bounded by said right side seal and said right interior seal, wherein respective portions of said folded bottom gusset form a portion of said left and right collapsible channels.

8. The reclosable pouch as recited in claim 7, wherein said left collapsible channel has an opening formed by a portion of a bottom edge of said front wall and a portion of a bottom edge of said rear wall.

9. The reclosable pouch as recited in claim 7, wherein an upper portion of said left side seal comprises first and second side seal segments separated by a gap, a storage chamber internal to said pouch and the ambient atmosphere external to said pouch being in fluid communication via an upper portion of said left collapsible channel and said gap when said upper portion of said left collapsible channel is open and being not in fluid communication via said upper portion of said left collapsible channel and said gap when said upper portion of said left collapsible channel is closed.

10. The reclosable pouch as recited in claim 7, wherein said airtight closure comprises a zipper having interengageable profile elements.

11. The reclosable pouch as recited in claim 7, further comprising a V-shaped interior seal having respective ends that meet said left side seal at respective locations and having a vertex separated from said left side seal, said V-shaped interior seal being disposed above said left collapsible channel.

12. The reclosable pouch as recited in claim 7, further comprising:

a first bottom seal where a bottom edge of said front wall is joined to a first bottom edge of said folded bottom gusset; and a second bottom seal where a bottom edge of said rear wall is joined to a second bottom edge of said folded bottom gusset, wherein said first and second bottom seals can be moved apart to unfold said folded bottom gusset, thereby expanding a bottom portion of said pouch.

13. A reclosable pouch comprising: a front wall, a rear wall, a bottom gusset comprising first and second gusset panels, left and right side seals, left and right interior seals, front and rear bottom seals, and an airtight closure disposed between and joined to uppermost portions of said front and rear walls, wherein respective portions of said front and rear walls form left and right collapsible channels, an interior of said pouch being in fluid communication with an exterior of said pouch when either of said left and right collapsible channels is open, said left collapsible channel being bounded by said left side seal and said left interior seal, and said right collapsible channel being bounded by said right side seal and said right interior seal, respective portions of said bottom gusset form a portion of said left and right collapsible channels, said first gusset panel being joined to said front wall in said front bottom seal, said second gusset panel being joined to said rear wall in said rear bottom seal, and said front and rear bottom seals being movable relative to each other to either expand or collapse a portion of said bottom gusset disposed between said left and right interior seals.

14. The reclosable pouch as recited in claim 13, wherein each of said left and right side seals comprises a respective upper portion where side edges of said front and rear walls are joined together and a respective lower portion where said side edges of said front and rear walls are joined to side edges of said bottom gusset.

15. The reclosable pouch as recited in claim 14, wherein each of said left and right interior seals comprises a respective upper portion where first portions of said front and rear walls are joined together and a respective lower portion where second portions of said front and rear walls are joined to respective portions of said bottom gusset.

* * * * *